US005724076A

United States Patent [19]

Ishida

[11] Patent Number: 5,724,076

[45] Date of Patent: Mar. 3, 1998

[54] OUT-OF-INK DETECTOR AND INK JET PRINTER

[75] Inventor: Nobuhisa Ishida, Kyoto, Japan

[73] Assignee: Rohm Co., Ltd., Kyoto, Japan

[21] Appl. No.: 553,535

[22] PCT Filed: Mar. 27, 1995

[86] PCT No.: PCT/JP95/00562

§ 371 Date: Nov. 30, 1995

§ 102(e) Date: Nov. 30, 1995

[87] PCT Pub. No.: WO95/26882

PCT Pub. Date: Oct. 12, 1995

[30] Foreign Application Priority Data

Apr. 4, 1994 [JP] Japan ..... 6-066065

[51] Int. Cl.[6] ..... B41J 2/195; B41J 2/175

[52] U.S. Cl. ..... 347/7; 347/86

[58] Field of Search ..... 347/7, 85, 86, 347/87, 70

[56] References Cited

U.S. PATENT DOCUMENTS

| | | | |
|---|---|---|---|
| 4,626,874 | 12/1986 | Murai et al. | 346/140 R |
| 4,782,754 | 11/1988 | Pohlig | 101/364 |
| 5,255,019 | 10/1993 | Mochizuki et al. | 346/140 |
| 5,289,211 | 2/1994 | Morandotti et al. | 346/140 |
| 5,329,304 | 7/1994 | Koizumi et al. | 347/7 |
| 5,488,395 | 1/1996 | Takayanagi et al. | 347/7 |
| 5,581,288 | 12/1996 | Shimizu et al. | 347/87 |

FOREIGN PATENT DOCUMENTS

| | | |
|---|---|---|
| 0370765 | 5/1990 | European Pat. Off. . |
| 0376922 | 7/1990 | European Pat. Off. . |
| 0440110 | 8/1991 | European Pat. Off. . |
| 60-171161 | 4/1985 | Japan . |
| 61-188154 | 8/1986 | Japan . |
| 61-186441 | 11/1986 | Japan . |

*Primary Examiner*—Safet Metjahic
*Assistant Examiner*—John Chizmar
*Attorney, Agent, or Firm*—Fish & Richardson P.C.

[57] ABSTRACT

An out-of-ink detector that detects the out-of-ink condition of an ink jet print head unit. The detector includes a pair of detection electrodes where one of the pair of detection electrodes is an electrically conductive film formed on a vibration plate of the ink jet head unit. The other pair of detection electrode is formed on the ink tank and connected to an exclusive line provided on a flexible cable.

9 Claims, 8 Drawing Sheets

CHANGES IN SHEET RESISTANCE OF ELECTRICALLY CONDUCTIVE FILM (ITO FILM) (Ω/□)

| No. | Connec-tion | Contact with ink | INT | After 3 hours of testing | After 6 hours of testing | After 14 hours of testing | After 21 hours of testing |
|---|---|---|---|---|---|---|---|
| 1 | 5V | In contact | 42.86 | 50.12 | 46.74 | 51.95 | 89.7 |
| 2 | 5V | Out of contact | 44.57 | 45.15 | 45.57 | 46.2 | 47.3 |
| 3 | GND | In contact | 41.41 | 41.34 | 41.28 | 41.8 | 41.75 |
| 4 | GND | Out of contact | 42.45 | 42.75 | 42.45 | 43.4 | 43.65 |

OUT-OF-INK DETECTOR AND INK JET PRINTER

BACKGROUND OF THE INVENTION

1. Field of the Invention

The present invention relates to an ink jet print head for printers, facsimiles, plotters, and word processors and to an out-of-ink detector for ink jet printers.

2. Description of the Related Art

Ink jet printers incorporating an ink jet print head are well known. These ink jet printers are of such a type that fine ink particles are jetted against a medium to be printed on, with a print head being out of contact with it. Thus these type of printers are advantageous in that the medium to be printed on have relaxed technical limits, and that they are capable of high-speed printing.

FIG. 12 schematically illustrates the basic principle of a Kaiser type piezoelectric head unit. As shown in the FIG. 12, an ink feed passage 102, a pressure chamber 103, and a nozzle 104 are provided in series on a substrate 101. A vibration plate 105 is provided on a surface of the substrate 101, outside the vibration plate 105 a piezoelectric element 106 is installed opposite to the pressure chamber 103. To apply voltage to the piezoelectric element 106, both of the element 106 sides are connected to a signal source 107. An ink container 109 is connected through a pipe 108 with the ink feed passage 102.

In the above configuration, the piezoelectric element 106 warps the vibration plate 105, thereby jetting ink 110 in the pressure chamber 103 in the form of ink droplets 110*a* through the nozzle 104 against recording medium for recording when the signal source 107 applies a voltage to the piezoelectric element 106. When voltage application to the piezoelectric element 106 is stopped after jetting ink, the vibration plate 105 returns to its original condition, so that the same amount of ink as has been jetted is fed under the capillary action of the nozzle from the ink container 109 through the ink feed passage 102 and the pipe 108.

Conventional ink jet print heads are provided with an ink tank from which ink is fed to their head substrates.

As shown in FIG. 10 and FIG. 11 showing a partial cross section of a conventional ink tank of FIG. 10, taken on line X—X, two electrodes 52*a* and 52*b* have been installed in an ink tank 50 to detect an out-of-ink condition by measuring the resistance between the electrodes 52*a* and 52*b*. When the ink tank 50 is filled with ink, a resistance of a few megohms can be measured because the two electrodes 52*a* and 52*b* are electrically connected with each other through the ink. On the other hand, when no ink is in the ink tank, the electrodes are not electrically connected together.

In FIG. 11, an ink outlet 54 is internally fitted with a filter 53 and externally fitted with an O-ring 55.

As described above, for out-of-ink detectors used with conventional ink jet print heads, the ink tank 50 must be provided with two electrodes, so that the detectors have posed problems of high electrode cost and a complicated structure of the ink tank 50.

It is an object of the present invention, in order to solve the problems, to provide an out-of-ink detector which allows the number of electrodes installed in an ink tank to be reduced, and the electrode cost to be reduced, and the ink tank to be structurally simplified.

SUMMARY OF THE INVENTION

According to a first aspect of the present invention, there is provided an out-of-ink detector which detects the out-of-ink condition of an ink jet print head having an ink jet head unit with a plurality of nozzles, through which the unit selectively jets ink, and having an ink tank feeding ink to the unit, the detector comprising a pair of electrodes and one of the two detection electrodes is electrically conductive film formed on the vibration plate of the ink jet head unit constituting a common electrode.

According to a second aspect of the present invention, in the detector of the first aspect, the electrically conductive film for the common electrode is the electrode on a ground side.

According to a third aspect of the present invention, in the detector of the first or second aspects, the ink tank has another detection electrode therein, which is connected to an exclusive line provided on a flexible cable.

According to a fourth aspect of the present invention, in the detector of the first, second, or third aspects, the ink feed pipe for supplying ink from the ink tank to the ink jet head unit is electrically conductive.

According to a fifth aspect of the present invention, there is provided an ink jet printer which includes the out-of-ink detector of the first, second, third, or fourth aspects.

An out-of-ink detector for ink jet printers according to the present invention has a pair of detection electrodes, one of which is electrically conductive film formed on a vibration plate in an ink jet head unit consisting a common electrode, thus reducing the number of electrodes by one, as well as the electrode cost.

The electrically conductive film consisting the common electrode, if used as the electrode on the ground side, is not increased in electrical resistance, so that correct out-of-ink detection can be performed.

Since the flexible cable is provided with an exclusive line from the electrically conductive film consisting the common electrode, if the other detection electrode in the ink tank is connected to another exclusive line, provided on the flexible cable, an out-of-ink detector can be provided by a simple structure because it is only necessary for the other detection electrode to be connected to the other exclusive line.

Being electrically conductive, the ink feed pipe allows the electrical resistance of the section between the electrode in the ink tank and the electrically conductive film consisting the common electrode to be reduced when ink is present in the ink tank, and thus the difference between the electrical resistance as measured when ink is unavailable and that as measured when it is available can be increased, so that accurate out-of-ink detection can be performed.

DESCRIPTION OF THE PREFERRED EMBODIMENT

Figure 1:
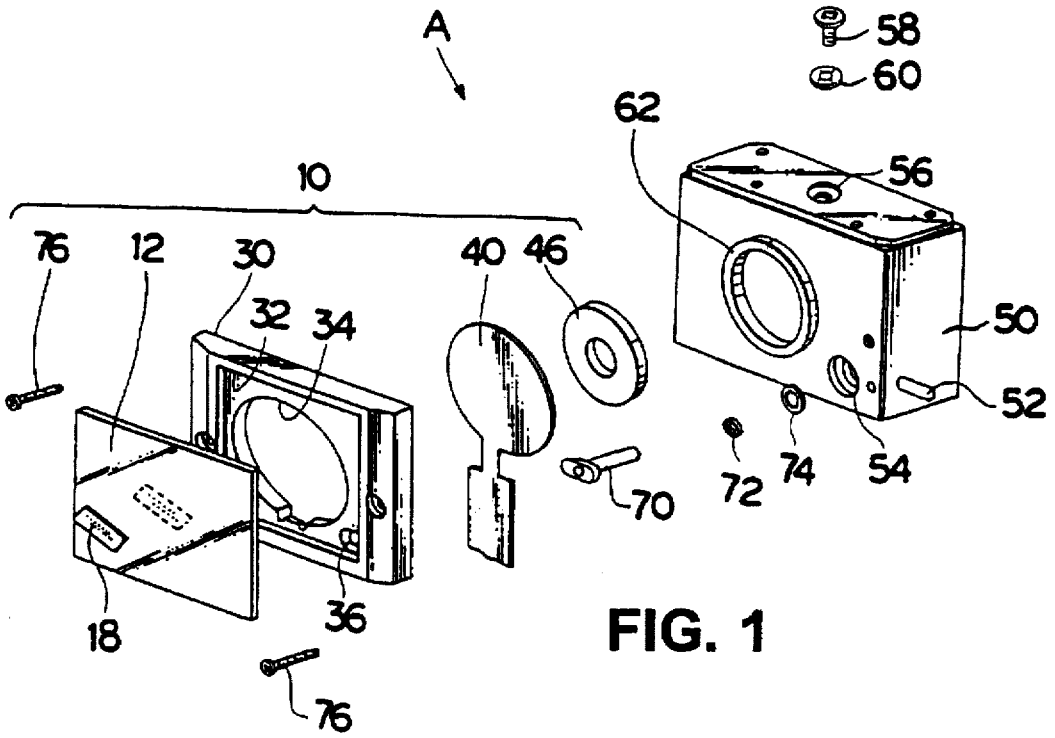
FIG. 1 is an exploded perspective view of an arrangement of an ink jet print head according to the present invention.

Referring now to the drawings, the present invention will be described in detail below.

As shown in FIG. 1, an ink jet head A has a head unit 10 and an ink tank 50, the unit 10 comprising a head substrate 12, a frame 30, a flexible cable, and an elastic member 46.

Figure 2:
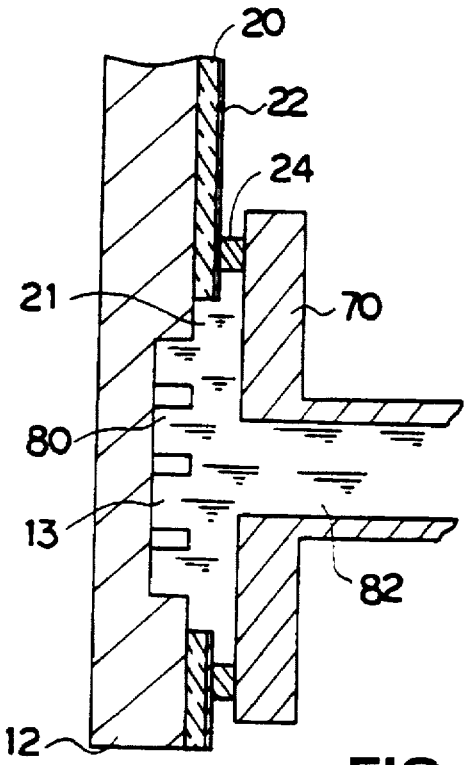
FIG. 2 is a cross-sectional view of a main part of an arrangement of an ink jet print head according to the present invention.
Figure 3:
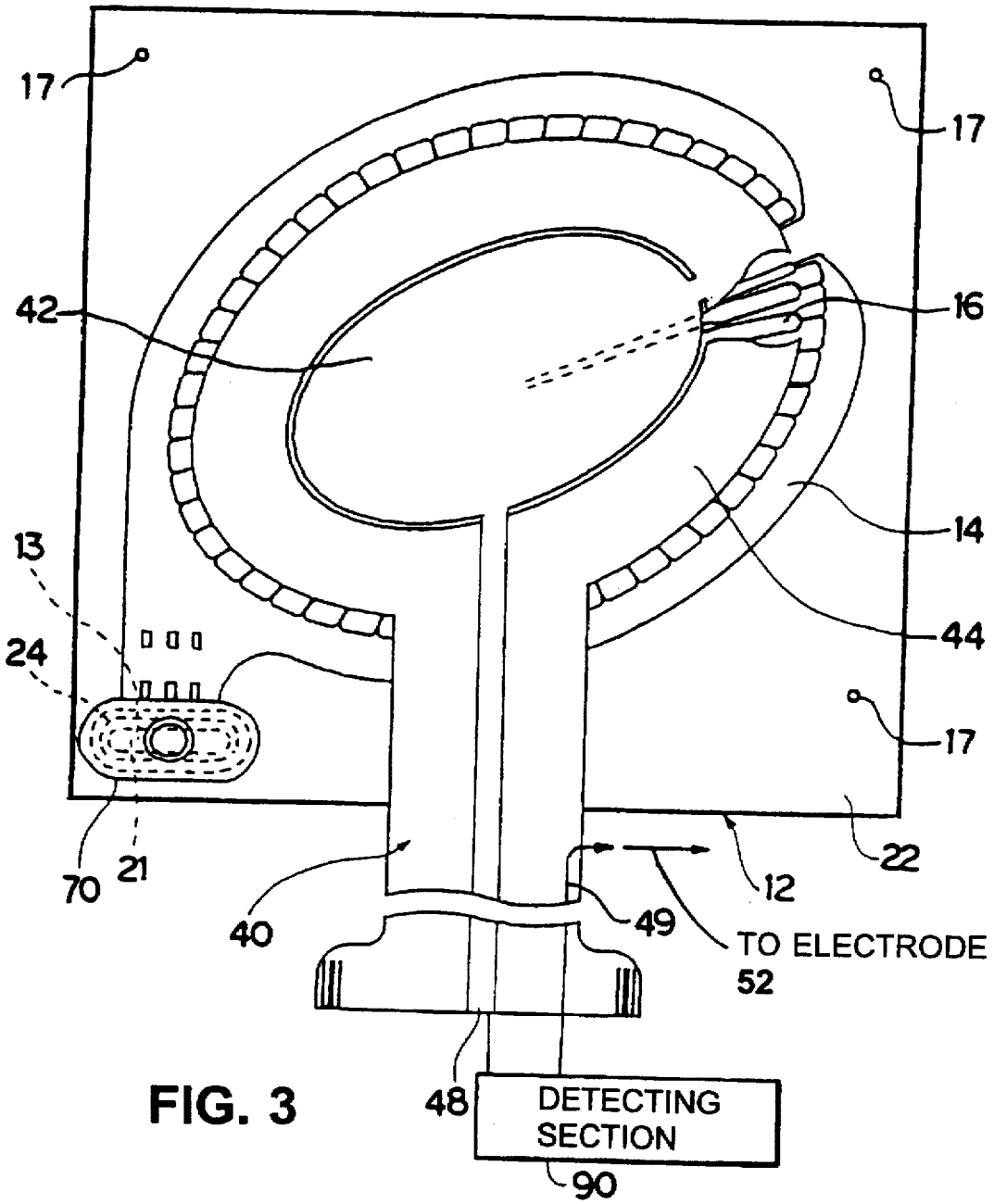
FIG. 3 schematically illustrates an arrangement of an ink jet print head according to the present invention.

The head substrate 12 is formed from glass resin or the like, and an ink passage pattern comprising an ink feed passage 13, a common ink passage 14, and a pressure chamber 16 is formed on the back of the substrate by etching, sand blasting, molding, or the like. On the face of the substrate an ink jet nozzle is formed, as shown in FIGS. 2, 3. Markings 17 for alignment are made at three corners of the head substrate 12.

As shown in FIG. 1, to optimize ink droplet size and jet speed and to prevent satellites, a nozzle plate 18 with a nozzle hole smaller in diameter than the nozzle of the head substrate 12 is disposed at the part of the head substrate 12 where nozzles are formed. The head substrate 12 has a vibration plate 20 on the back thereof as shown in FIG. 2 and further has piezoelectric elements (not shown), disposed at positions in the vibration plate 20 corresponding to the pressure chambers 16. As shown in FIGS. 2 and 3, the vibration plate 20 is provided with an opening 21 for passing ink and overlaid with electrically conductive film 22 (ITO film) forming a common electrode for the piezoelectric elements.

The head substrate 12 is bonded to the frame 30 having a substantially oval opening 34. That is, a recess 32 is formed at the front of the frame 30, into which the head substrate 12 is fitted.

As shown in FIGS. 1 and 3, a flexible cable 40 is disposed at the opening 34 of the frame 30, i.e., on the back of the head substrate 12, and a common electrode section 42 and a separate electrode section 44 are formed nearly in the middle of this cable where a large number of electrodes applying a drive voltage to the piezoelectric elements are formed. The common electrode section 42 is connected to the electrically conductive film 22 on the vibration plate 20, and the electrodes in the separate electrode section 44 are connected to the piezoelectric elements. As shown in FIG. 3, the flexible cable 40 is provided with a common line 48 extended from the common electrode section 42 and with an ink tank electrode line 49.

As shown in FIG. 1, the elastic member 46 is disposed between the flexible cable 40 and the ink tank 50 to press the flexible cable 40 against the head substrate 12 for ensuring stable contact between the electrode sections in the flexible cable 40 and the head substrate 12.

The ink tank 50 holds ink, and the ink is fed through an ink feed opening 54 in FIG. 1 to the head. Projections 62 disposed on the surface of the ink tank 50 allow the elastic member 46 to be correctly positioned. A cap 58 fitted through an O-ring 60 over an ink replenishment hole 56 on top of the ink tank 50 is removed to replenish the tank with ink. The ink tank 50 is provided with only one electrode 52 for out-of-ink detection. The electrode 52 is connected with the ink tank electrode line 49 (see FIG. 3) attached to the flexible cable 40. Instead of replenishing the ink tank 50 with ink, the ink tank 50, when emptied of ink, may be replaced with a new ink-filled tank.

An ink feed pipe 70, attached through an O-ring 74 and a filter 72 to the ink feed opening 54 of the ink tank 50, is inserted through an opening 36 in the frame 30. As shown in FIGS. 2 and 3, the ink feed pipe 70 is connected through an O-ring 24 to an opening 21 of the vibration plate 20. The head substrate 12, the vibration plate 20, the electrically conductive film 22, the O-ring 24, and the ink feed pipe 70 form an ink holding space 80 as shown in FIG. 2.

In the ink jet print head A arranged as described above, the electrically conductive film 22 on the vibration plate 20 is used as one of the out-of-ink detection electrodes, and the electrode 52 in the ink tank is used as the other. Both electrodes are connected with a detecting section 90 (see FIG. 3). When an ink flow passage from the ink tank 50 through the ink feed pipe 70 to the head substrate 12 is full of ink, the ink feed passage 13 of the head substrate 12 is filled with ink 82, so that the ink 82 comes in contact with both the electrically conductive film 22 on the vibration plate 20 and the electrode 52, thus causing current flow between the two electrodes, with a value of resistance Given. On the other hand, when the ink tank 50 is emptied of ink, current does not flow between the electrodes, with another value of resistance Given. The detecting section 90 can therefore measure the resistance between the two electrodes to detect an out-of-ink condition.

Because the ink feed pipe 70 is as small as 1 to 1.5 mm in inner diameter, the electrical resistance of ink filling the ink feed pipe 70 is increased as the pipe becomes longer. Accordingly, even when the ink feed passage 13 is filled with the ink 82, the electrical resistance between the two electrodes is increased, so that a smaller difference arises between the resistance as measured when the tank is empty of ink and that as measured when the tank is filled with ink. Thus causing the detecting section 90 may abnormally generate an out-of-ink output from time to time even if the tank is not empty.

To prevent such a malfunction, the ink feed pipe 70 is preferably made electrically conductive. Doing so allows the electrical conductivity of the ink feed pipe 70 to counteract the effect of an increase in electrical resistance of ink in the ink feed pipe 70 if the ink feed pipe 70 becomes longer, thus increasing the electrical resistance of the ink. In this case, the ink feed pipe 70 is arranged so as not to come in contact with the electrode 52, and thus making the ink feed pipe 70 electrically conductive poses no problem with out-of-ink detection. Since, for the same reason as described above, providing the O-ring 24 with electrical conductivity and electrically contacting the ink feed pipe 70 with the electrically conductive film 22 do not obstruct out-of-ink detection, material for the O-ring 24 can be more freely selected.

A way to make the ink feed pipe 70 electrically conductive is to form the ink feed pipe 70 from an electrically conductive material or to form an electrically conductive coating on the internal surface of the ink feed pipe 70 by plating or the like.

Because the present invention uses the electrically conductive film 22 formed on the vibration plate 20 as one of the out-of-ink detection electrodes, only one electrode has to be installed in the ink tank 50, so that electrode cost can be reduced. In addition, since the electrode 52 is connected to the ink tank electrode line 49, which is an exclusive line provided on the flexible cable 40, detector arrangement is simplified, so that the detector is not increased in size.

Figure 4:
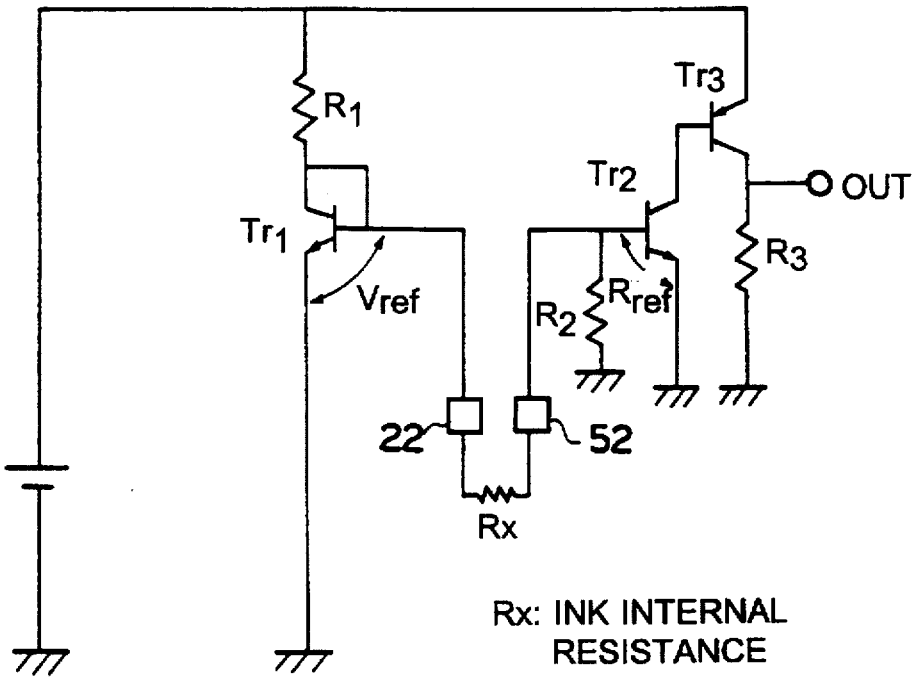
FIG. 4 is a circuit diagram showing an example of an arrangement of a detector circuit according to the present invention.

An embodiment of the circuit in the detecting section 90 of the out-of-ink detector is described below. The embodiment is arranged as shown in FIG. 4. When both the electrode 52 and the electrically conductive film 22 come into contact with ink, so that current flows between the electrode 52 and the electrically conductive film 22, current from a power source flows through a resistor R1, the electrically conductive film 22, ink internal resistance Rx, and the electrode 52 to a resistor R2, thus applying a base voltage to a transistor Tr2 to energize the transistor. Following the transistor Tr2, a transistor Tr3 is energized, and thus a predetermined potential difference is generated between an output terminal and ground. When no current flows between the two electrodes, on the other hand, the transistor Tr3 is deenergized, and thus there is no potential difference between the output terminal and ground. An out-of-ink condition can therefore be detected by examining whether or not there is potential difference between the output terminal and ground.

Figure 5:
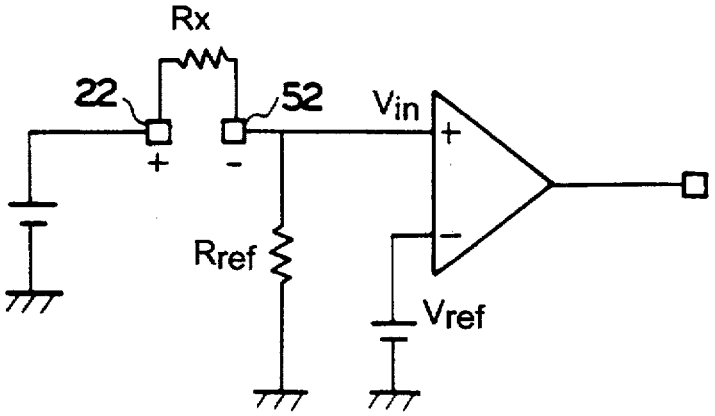
FIG. 5 is a circuit diagram of another example of the arrangement of the detector circuit according to the present invention.

Another embodiment of the circuit in the detecting section 90 is described below. As shown in FIG. 5, when current flows between the electrode 52 and the electrically conductive film 22, current from the power source flows through a resistor Rref, and thus a voltage Vin on the plus side of a comparator is increased, so that the voltage Vin becomes higher than a reference voltage Vref on the negative side of the comparator (Vin > Vref). When no current flows between the electrode 52 and the electrically conductive film 22, on the other hand, the voltage Vin becomes not higher than the reference voltage Vref on the negative side of the comparator (Vin ! Vref). A comparison of the voltages Vin and Vref allows an out-of-ink condition to be detected.

Figures 6, 7:
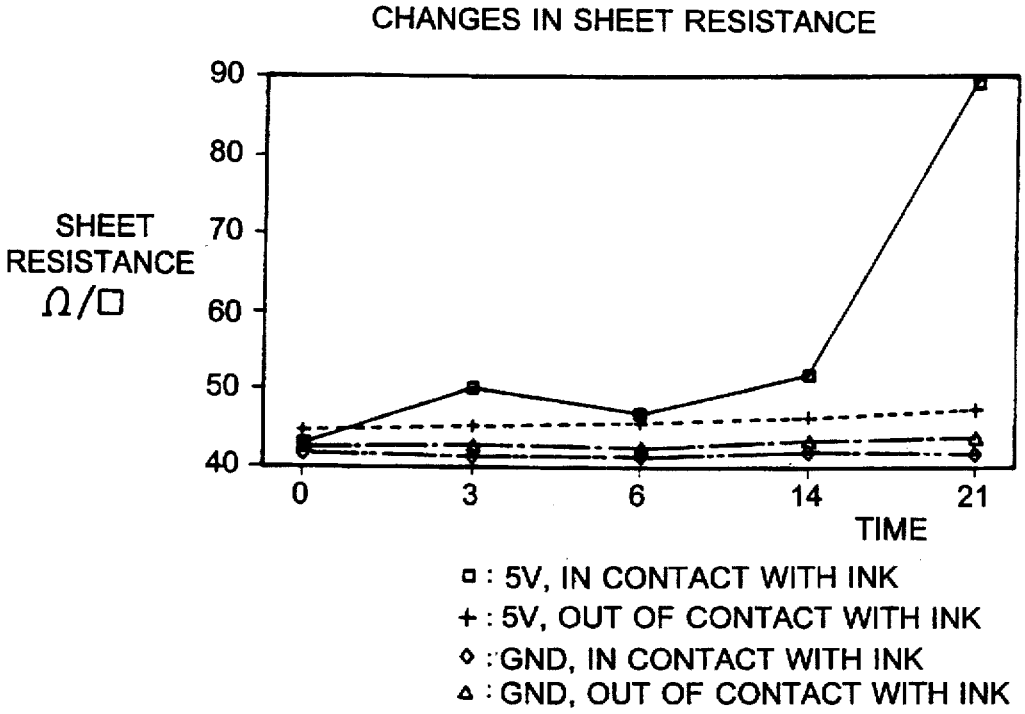
FIG. 6 is a table listing the results of sheet resistance tests on an electrically conductive film according to the present invention.
FIG. 7 graphically illustrates the results of the sheet resistance tests on the electrically conductive film according to the present invention.

When the electrically conductive film 22 on the vibration plate 20 is used as one of the two out-of-ink detection electrodes as described above, it matters whether the film is used as the electrode on the positive side or on the GND (ground) side. FIGS. 6 and 7 illustrate the results of tests on the electrically conductive film 22 relative to the above point.

As illustrated in FIG. 6, time-dependent changes in the sheet resistance of the electrically conductive film 22 were measured in the following cases: (1) the electrically conductive film being used as a 5-V-applied electrode on the positive side, the film being in contact with ink, (2) the electrically conductive film being used as a 5-V-applied electrode on the positive side, the film not being in contact with ink, (3) the electrically conductive film being used as the electrode on the GND side, the film being in contact with ink, and (4) the electrically conductive film being used as the electrode on the GND side, the film not being in contact with ink.

As illustrated in FIG. 7, in Case (1) above, the sheet resistance was slightly increased after three hours of testing, reduced after six hours of testing, increased again after 14 hours of testing, and considerably increased after 21 hours of testing. Since, in spite of ink filled between the two electrodes, current may therefore be expected not to flow between them when the electrically conductive film 22 serves as the electrode on the positive side because the resistance of the film is increased, the electrically conductive film 22 is preferably used as the electrode on the GND side.

Since out-of-ink detection, that is, voltage application across the two electrodes is not performed during the entire period of printer use but for as short as five milliseconds for every line of printing, time of voltage application to the electrodes does not total a large extent, nor does using the electrically conductive film 22 as the electrode on the positive side directly pose a problem. Considering prolonged periods of printer use, however, the electrically conductive film 22 is preferably used as the electrode on the GND side. The sheet resistance of the electrically conductive film 22 was not found to change even after 200 hours of testing when the film was used as the electrode on the GND side; that is, the film was left in ink, with no voltage applied to the film.

On the other hand, voltage application to the electrode 52 in the ink tank 50 is expected to cause ink to be deposited on the electrode 52 and thus increase the resistance thereof, leading out-of-ink detection to be hindered as mentioned above. This problem does not arise both because the time of voltage application to the electrodes does not total a large extent and because the ink tank, when emptied of ink, is commonly replaced with a new tank filled with ink.

Figure 8:
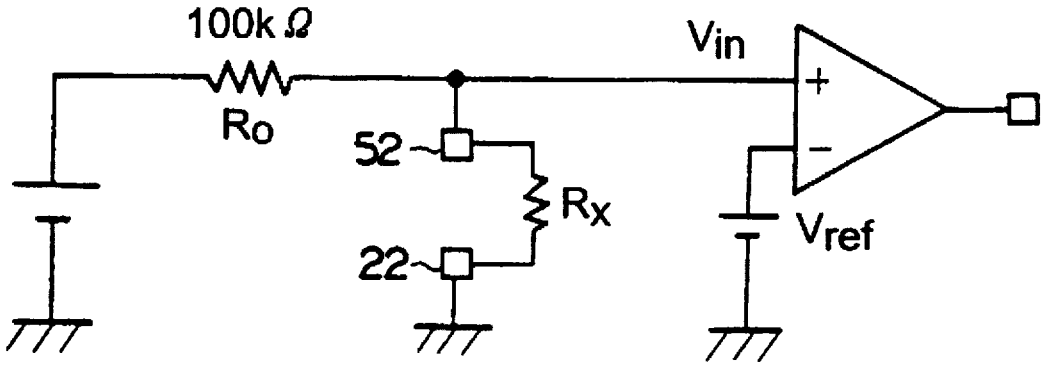
FIG. 8 is a circuit diagram showing a detector circuit as arranged when an electrically conductive film according to the present invention is connected to a GND side.

FIG. 8 shows an embodiment of the circuit in the detecting section 90 in which the electrically conductive film 22 is used as the electrode on the GND side, taking into account the above description.

In FIG. 8, when current does not flow between the electrode 52 connected to the power source and the electrically conductive film 22 connected to the GND side due to an out-of-ink condition, the voltage of the power source is directly applied to the positive side of the comparator, and thus the voltage Vin on the positive side of the comparator is increased, so that the voltage Vin becomes higher than the reference voltage Vref on the negative side of the comparator (Vin > Vref). On the other hand, when current flows between the electrode 52 and the electrically conductive film 22, current from the power source flows through a resistor Ro on the power source side and ink internal resistance Rx to the GND side, and thus the voltage Vin on the positive side of the comparator is reduced due to a voltage drop across the resistor Ro on the power source side, so that the voltage Vin becomes lower than the reference voltage Vref (Vin < Vref). Thus a comparison of the voltage Vin and the reference voltage Vref allows an out-of-ink condition to be detected.

Figure 9:
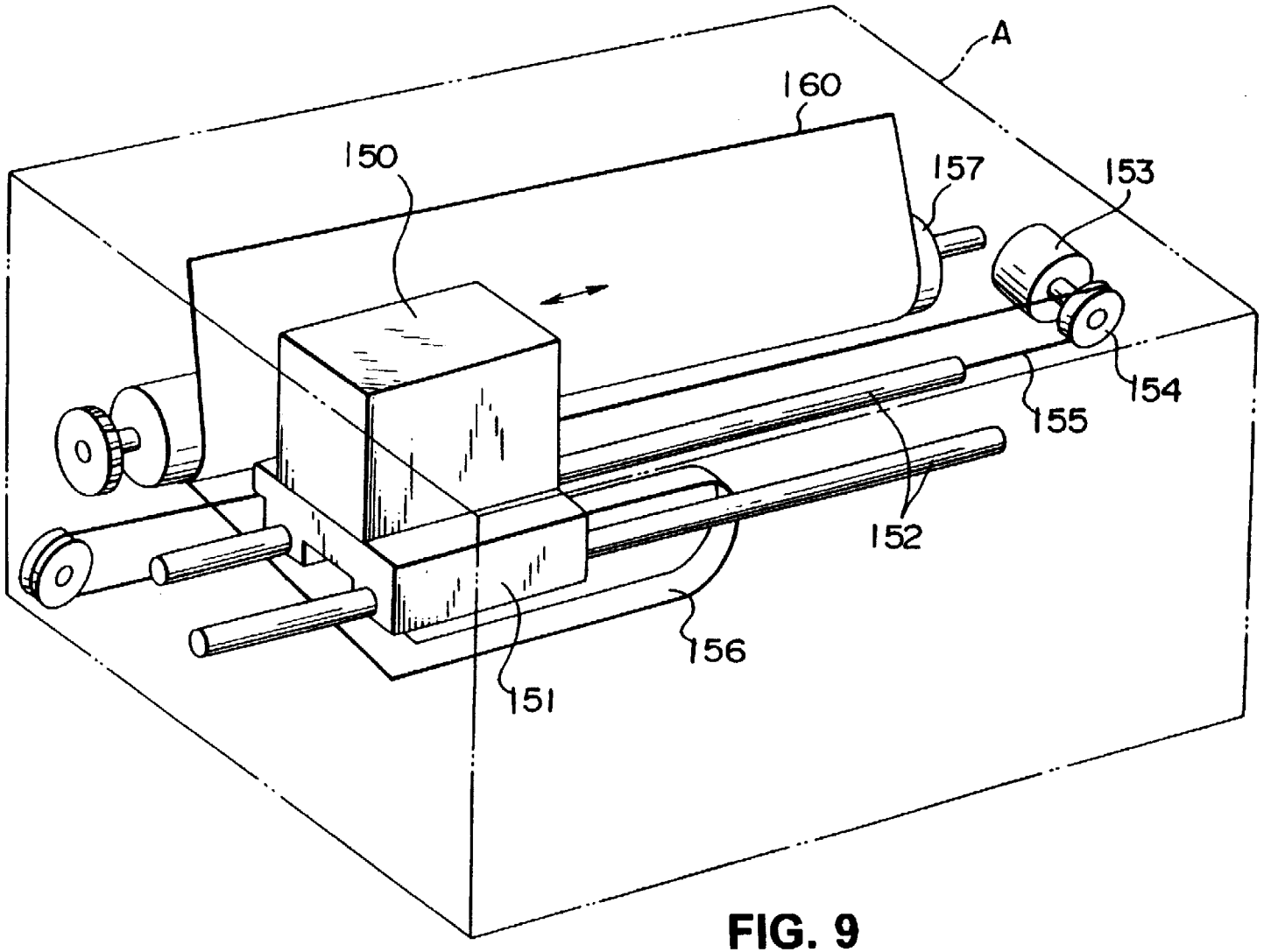
FIG. 9 is a perspective view of a main part of a printer including an ink jet print head according to the present invention.
Figure 10:
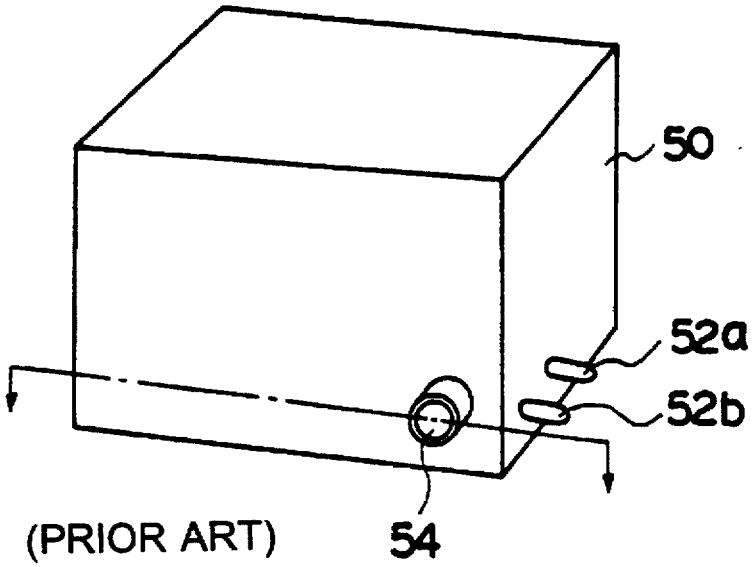
(PRIOR ART) FIG. 10
FIG. 10 is a perspective view of an arrangement of a conventional ink tank.
Figure 11:
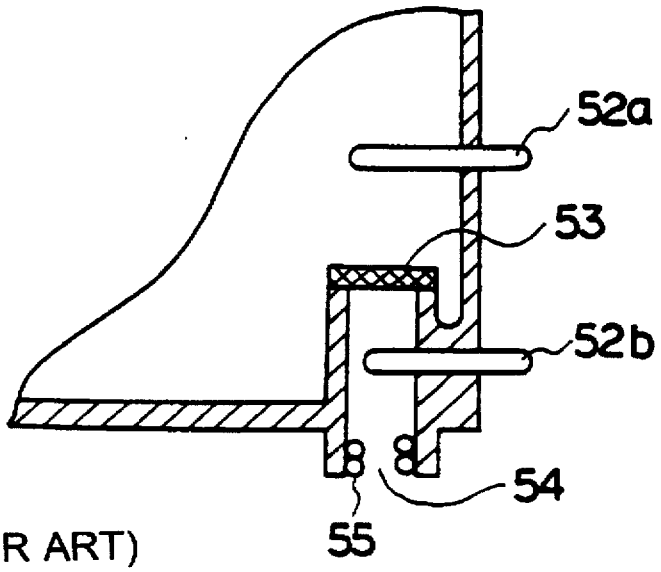
(PRIOR ART) FIG. 11
FIG. 11 is a cross-sectional view of a main part of the ink tank of FIG. 10, taken on line X—X.
Figure 12:
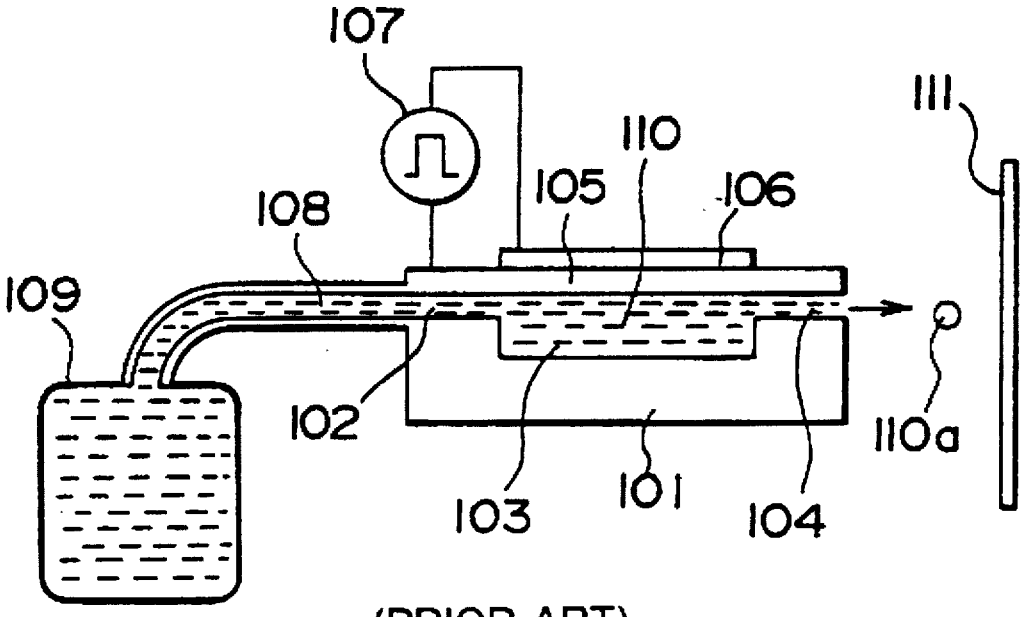
(PRIOR ART) FIG. 12
FIG. 12 schematically illustrates the principle of a piezoelectric head unit.

As shown in FIG. 9, in a printer using an ink jet print head arranged as described above, the ink jet print head is disposed in a cartridge 150 positioned in a carriage 151, which is provided so that it can slide on two guides 152; that is, it travels horizontally as a wire 155 moves horizontally due to rotation of a pulley 154 driven by a motor 153. Through the flexible cable, a drive controller (not shown) controls ink jets from the ink jet print head. Paper 160 wound around a platen 157, which is to be printed on, faces the print surface of the cartridge 150.

Industrial applicability

As described above, the present invention allows the number of electrodes to be reduced by one and the electrode cost to be cut.

The electrically conductive film for the common electrode, if used as the electrode on the ground side, is not increased in electrical resistance, so that correct out-of-ink detection can be performed.

Since the other detection electrode in the ink tank is connected to the exclusive line provided on the flexible cable, an out-of-ink detector can be provided by a simple structure having the other detection electrode connected to the line.

Being electrically conductive, the ink feed pipe allows the electrical resistance of the section between the electrode in the ink tank and the electrically conductive film for the common electrode to be reduced when ink is present in the ink tank, and thus the difference between the electrical resistance as measured when ink is unavailable and that as measured when it is available can be increased, so that accurate out-of-ink detection can be performed.

What is claimed is:

1. An out-of-ink detector for detecting the out-of-ink condition of an ink jet print head having an ink jet head unit with a plurality of nozzles, through which the unit selectively jets ink, and having an ink tank which feeds ink to said ink jet heat unit, comprising:

a pair of detection electrodes, one of said pair of detection electrodes being an electrically conductive film formed on a vibration plate of said ink jet head unit to form a common electrode, and the other one of the pair of detection electrodes being formed on the ink tank and connected to an exclusive line provided on a flexible cable.

2. The out-of-ink detector according to claim 1, wherein the electrically conductive film for the common electrode is the electrode on a ground side.

3. The out-of-ink detector according to claims 1 or 2, further comprising an electrically conductive ink feed pipe for feeding ink from the ink tank to the ink jet head unit.

4. An ink jet printer, including the out-of-ink detector of claim 1.

5. An ink jet printer, including the out-of-ink detector of claim 2.

6. An ink jet printer, including the out-of-ink detector of claim 3.

7. The out-of-ink detector according to claim 1 further comprising a detecting section configured to measure resistance between the pair of detection electrodes to detect the out-of-ink condition.

8. The out-of-ink detector according to claim 2 further comprising a detecting section configured to measure resistance between the pair of detection electrodes to detect the out-of-ink condition.

9. The out-of-ink detector according to claim 3 further comprising a detecting section configured to measure resistance between the pair of detection electrodes to detect the out-of-ink condition.

* * * * *